US011118415B2

(12) United States Patent
Eriksen

(10) Patent No.: US 11,118,415 B2
(45) Date of Patent: Sep. 14, 2021

(54) METHOD AND ARRANGEMENT FOR TRANSPORTING DRILL PIPES

(71) Applicant: RIGTEC AS, Røyneberg (NO)

(72) Inventor: Morten Eriksen, Røyneberg (NO)

(73) Assignee: RIGTEC AS, Røyneberg (NO)

( * ) Notice: Subject to any disclaimer, the term of this patent is extended or adjusted under 35 U.S.C. 154(b) by 13 days.

(21) Appl. No.: 16/311,297

(22) PCT Filed: Jun. 30, 2017

(86) PCT No.: PCT/EP2017/066311
§ 371 (c)(1),
(2) Date: Dec. 19, 2018

(87) PCT Pub. No.: WO2018/010980
PCT Pub. Date: Jan. 18, 2018

(65) Prior Publication Data

US 2019/0186214 A1 Jun. 20, 2019

(30) Foreign Application Priority Data

Jul. 15, 2016 (SE) ..... 1651069-5

(51) Int. Cl.
*E21B 19/15* (2006.01)
*E21B 19/06* (2006.01)

(52) U.S. Cl.
CPC ..... *E21B 19/155* (2013.01); *E21B 19/06* (2013.01); *E21B 19/15* (2013.01)

(58) Field of Classification Search
CPC ..... E21B 19/083; E21B 19/14; E21B 19/146; E21B 19/15; E21B 19/16; E21B 19/20; E21B 19/155
See application file for complete search history.

(56) References Cited

U.S. PATENT DOCUMENTS 3,194,313 A 7/1965 Dalrymple
5,244,329 A 9/1993 McGill et al.
6,581,698 B1 * 6/2003 Dirks ..... E21B 19/20 175/52

(Continued)

FOREIGN PATENT DOCUMENTS

CN 101787860 A 7/2010
CN 101796260 A 8/2010

(Continued)

OTHER PUBLICATIONS

PCT International Search Report and Written Opinion dated Oct. 4, 2017 for International Application No. PCT/EP2017/066311, 9 pages.

(Continued)

*Primary Examiner* — Brad Harcourt
(74) *Attorney, Agent, or Firm* — RMCK Law Group, PLC

(57) ABSTRACT

Method for transporting drill pipes (12) to and/or from a drill string (14) of a drill rig comprising a plurality of connected drill pipes (12), the method comprising repeatingly lifting/lowering single drill pipes (12) one by one from/to a lower region (28) to/from an upper region (30) adjacent to an upper end (32) of the drill string (14). An arrangement (10) for transporting drill pipes (12) to a drill string (14) and a drill rig comprising the arrangement (10) are also provided.

17 Claims, 9 Drawing Sheets

(56) References Cited

U.S. PATENT DOCUMENTS

| | | | | |
|---|---|---|---|---|
| 2005/0126792 | A1* | 6/2005 | Berry | E21B 19/20 166/379 |
| 2014/0124218 | A1* | 5/2014 | Pilgrim | E21B 19/083 166/380 |
| 2016/0024852 | A1 | 1/2016 | Kannegaard et al. | |

FOREIGN PATENT DOCUMENTS

| | | | |
|---|---|---|---|
| CN | 105275415 | A | 1/2016 |
| CN | 106639923 | A | 5/2017 |
| EA | 014374 | B1 | 10/2010 |
| EP | 0267002 | A2 | 5/1988 |
| RU | 2103475 | C1 | 1/1998 |
| WO | 0133034 | A1 | 5/2001 |
| WO | 2001066905 | A2 | 9/2001 |
| WO | 2006075914 | A1 | 7/2006 |
| WO | 2010098672 | A1 | 9/2010 |

OTHER PUBLICATIONS

Communication Pursuant to Article 94(3) EPC dated Mar. 4, 2020 from European Patent Office regarding EP Application No. 17734325.8, 4 pages.

English language translation of Chinese Office Action and Search Report dated Apr. 13, 2020 for Chinese Application No. 201780043806.0, 8 pages.

* cited by examiner

METHOD AND ARRANGEMENT FOR TRANSPORTING DRILL PIPES

CROSS-REFERENCE TO RELATED APPLICATIONS

This application is a 371 U.S. National Stage of International Application No. PCT/EP2017/066311, filed Jun. 30, 2017, which claims priority to Swedish Application No. 1651069-5, filed on Jul. 15, 2016. The disclosures of each of the above applications are incorporated herein by reference in their entirety.

TECHNICAL FIELD

The present disclosure generally relates to the transportation of drill pipes to and from a drill string of a drill rig. In particular, a method for transporting drill pipes to a drill string of a drill rig comprising a plurality of connected drill pipes, a method for transporting drill pipes from the drill string and an arrangement for these purposes are provided.

BACKGROUND

In the drilling of oil and gas wells, a drill string comprising a plurality of connected drill pipes and a drill bit mounted on the lower end thereof is typically suspended from a derrick on a drill rig. The drill string may be suspended from a travelling block in the derrick by a swivel which enables rotational force to be applied to the drill string, typically by a topdrive hanging below the travelling block, to advance the depth of the drilled well bore. As the depth of the well bore increases and the drill string is lowered or tripped in, additional sections of connected drill pipes are added to the drill string at its upper end.

The drill string also sometimes needs to be pulled or tripped out, i.e. raised, from the well bore, for example when the drilling operation is completed or if the drill bit is to be changed. When the drill string has been pulled until a section of connected drill pipes are above a drill floor of the drill rig, the section of connected drill pipes is unthreaded from the remainder of the drill string and removed therefrom.

WO 2006075914 A1 discloses a device for handling and storage of drill string sections composed of a plurality of drill pipes and for assembly or disassembly of a drill string on a drilling installation. The device comprises an upper and a lower fingerboard for positioning of upright drill string sections in a storage area and holding the drill string section in a chosen storage position. The upper and lower fingerboards are each provided with a set of transport means for substantially horizontal displacement of the drill string section along guideways. The device further comprises means positioned in close proximity to the upper and lower fingerboards, respectively, for joining and separating the drill section to/from the drill string.

EP 0267002 A2 discloses an apparatus for moving pipe stands, composed of several pieces of pipe, between a well bore center line and a racking assembly. The apparatus comprises an arm having a gripping head mounted thereon and the arm is extendable and retractable relative to a carriage mounted on the drilling rig working board.

SUMMARY

In the arrangements described in WO 2006075914 A1 and EP 0267002 A2, several drill pipes are connected as pipe stands and stored at an intermediate location prior to (or after) being connected to (or disconnected from) the drill string. These arrangements thus require the drill rig to contain storage space for the drill stands. This adds complexity to the structure of the drill rig. In addition, the height of the drill stands adds to the total height of the derrick and consequential increased structural dimensioning, instability and costs for the derrick.

One object of the present disclosure is to provide an effective, simple and reliable method for transporting drill pipes to a drill string in a drill rig.

A further object of the present disclosure is to provide a method for transporting drill pipes to and from a drill string in a drill rig that enables effective (fast) supply of drill pipes to a drill string that is continuously moved in or out of the well.

A still further object of the present disclosure is to provide a method for transporting drill pipes to a drill string in a drill rig that enables the height of the drill rig to be reduced.

A still further object of the present disclosure is to provide a method for transporting drill pipes to a drill string in a drill rig that reduces or eliminates the need for storage space for drill pipes, such as an intermediate storage space along the transportation path to/from the drill string.

A still further object of the present disclosure is to provide a method for transporting drill pipes from a drill string in a drill rig that solves one or more of the above objects.

A still further object of the present disclosure is to provide an arrangement for transporting drill pipes to and/or from a drill string in a drill rig having an effective, simple, reliable and cheap structure and enabling a reduced height and reduced storage space requirements for the drill rig.

According to one aspect, there is provided a method for transporting drill pipes to a drill string of a drill rig comprising a plurality of connected drill pipes, the method comprising repeatingly lifting single drill pipes one by one from a lower region to an upper region adjacent to an upper end of the drill string.

The method enables a continuous transportation of single drill pipes, one after the other, towards (or away from) the drill string, for example at a speed of 1 800 meters of pipes per hour without any intermediate storage or stop of drill pipes, or stands of drill pipes, at a movement (e.g. a continuous movement) of the drill string at a speed of 0.5 meters per second. The removal of the intermediate storage or stop of drill pipes contributes to a reduced height of the drill rig.

The method may ensure that there is always a gripping mechanism or a supporting mechanism at each end (e.g. within 5% of the length) of the transported drill pipe. This improves control of the drill pipe movement and avoids, for example, unsafe waiving of the drill pipe by holding it too far away from one or both ends. Each pair of gripping mechanisms and/or supporting mechanisms may be referred to as a manipulator pair.

When a drill pipe has been lifted to the upper region, a lower end of the drill pipe may be positioned at substantially the same height as the upper end of the drill string. Alternatively, the lower end of the drill pipe may be positioned vertically above the upper end of the drill string when the drill pipe is in the upper region.

The upper region may be horizontally offset with respect to the drill string. Alternatively, the upper region may be located substantially above the drill string.

The lower region may be a region in proximity to the drill floor of the drill rig. Alternatively, or in addition, the lower region may be a region at a height of the drill rig where the drill pipes are horizontally positioned. The lower region may be horizontally offset with respect to the drill string. According to one variant, a lower end of the single drill pipe is positioned at substantially the same height as the drill floor when the drill pipe is in the lower region.

Throughout the present disclosure, single drill pipes refer to unconnected and separate drill pipes, in contrast to a drill pipe stands each composed of a plurality of connected drill pipes. The drill pipes according to the present disclosure may be straight and rigid. The length of each drill pipe may be 8 to 12 meters, such as approximately 10 meters. The ends of each drill pipe may be threaded to be threadingly engaged with an adjacent drill pipe or an intermediate joint member.

The repeated lifting may be sequential, i.e. a second single drill pipe may be lifted from the lower region to the upper region after a first single drill pipe has been lifted from the lower region to the upper region. However, two separate lifts may be partly overlapping in time, i.e. a second single drill pipe (possibly also one or more further single drill pipes) may be moving between the lower region and the upper region at the same time as a first single drill pipe is moving between the lower region and the upper region.

The drill pipe may be oriented substantially vertically along the lifting from the lower region to the upper region. When the drill pipe is in the lower region, a lower thread of the drill pipe, i.e. a trailing end with respect to the lifting movement, may be cleaned and/or lubricated. The method may thus further comprise cleaning and/or lubricating a trailing end of a single drill pipe in the lower region, preferably when the drill pipe is in a substantially vertical orientation.

As their names imply, the upper region is a region at a higher height than the lower region. According to one variant, the repeated lifting is carried out in a substantially vertical direction from the lower region to the upper region. However, alternative lifting paths from the lower region to the upper region, including inclined paths, are conceivable. In case an inclined path from the lower region to the upper region is employed, each single drill pipe may be substantially vertically oriented or be oriented substantially parallel with the lifting path. The repeated lifting may be carried out along one single path, or along two or more substantially parallel paths.

The single drill pipes may be moved a distance of 10 to 20 meters, such as approximately 15 meters, from the lower region to the upper region. The single drill pipes may be moved from the lower region to the upper region at a speed of 0.2 to 1.0 meters per second, such as 0.4 to 0.8 meters per second, such as approximately 0.6 meters per second.

The method may be used to transport drill pipes to a continuously lowered drill string. In addition, the method may be used to transport drill pipes to a repeatedly lowered drill string, e.g. where the drill string is alternatingly lowered and stopped. The method according to the present disclosure is also suitable for transporting drill pipes to a drill string while drilling.

The method may thus further comprise continuously lowering the drill string. The drill string may be continuously lowered at a speed of 0.2 to 1.0 meters per second, such as 0.3 to 1.0 meters per second, such as 0.4 to 0.6 meters per second, such as 0.5 meters per second.

Alternatively, the method may comprise lowering the drill string, such as alternatingly lowering and stopping the drill string. As a further alternative, the method may comprising drilling with the drill string while transporting drill pipes to the drill string.

The repeated lifting of single drill pipes may be carried out by at least two lifting devices in an alternating manner. In this manner, it is possible to add single drill pipes in parallel to increase the speed as desired.

Each lifting device may, when holding a single drill pipe (e.g. when moving from the lower region to the upper region), be moved at a speed of 0.4 to 0.8 meters per second, such as approximately 0.6 meters per second. When empty, i.e. when not holding any drill pipe (e.g. when moving from the upper region to the lower region), each lifting device may be moved at a speed of 0.8 to 1.2 meters per second, such as approximately 1 meter per second.

The method may further comprise repeatingly moving single drill pipes one by one from the upper region to a connection region, where the drill pipe can be connected to the upper end of the drill string. Each single drill pipe may be substantially vertically oriented when being moved from the upper region to the connection region. The single drill pipes may be connected one by one to a continuously lowered (or raised) drill string.

The connection region may be positioned substantially above the drill string. According to one variant, the upper region and the connection region are at substantially the same height. In this case, the repeated moving of single drill pipes one by one from the upper region to the connection region is constituted by a substantially horizontal movement. A lower end of the single drill pipe may be positioned close to (e.g. slightly above) the upper end of the drill string when the drill pipe is located in the connection region. A connection region according to the present disclosure may thus be constituted by a region where the drill pipe is in a connecting position, ready to be connected to the drill string, e.g. a region along the drill string center line.

The method may further comprise repeatingly connecting a single drill pipe in the connection region to the upper end of the drill string. The connection may be carried out by means of a screwing device known in the art.

The repeated movement of single drill pipes from the upper region to the connection region may be carried out by a moving device, or by several moving devices, as described below.

The repeated lifting of single drill pipes and the repeated moving of single drill pipes may be carried out simultaneously. Thus, several single drill pipes at different locations may be moved towards the drill string at the same time as a train. This provides a faster delivery of drill pipes. For example, when a first single drill pipe is located in the upper region, ready to be moved (or on its way) to the connection region, a second single drill pipe may be located in the lower region, ready to be moved to the upper region. Once the first single drill pipe has been moved to the connection region and the second single drill pipe has been moved to the upper region, a third single drill pipe may be located in the lower region, ready to be moved (or on its way) to the upper region etc.

The method of transportation thus resembles a conveyor where a plurality of single drill pipes, at different locations, are simultaneously transported towards the drill string.

The method may further comprise repeatingly tilting single drill pipes one by one in the lower region from a substantially horizontal orientation to a substantially vertical orientation. This tilting of the drill pipes, e.g. between horizontal and vertical, in the lower region, contributes to a reduced height of the drill rig.

The method according to the present disclosure thus provides for a continuous movement of drill pipes from a horizontal orientation in the lower region, to a vertical orientation, to the upper region and to the connection region. This continuous movement resembles an assembly line or train where a trailing end of a first drill pipe is immediately followed by a leading end of a second drill pipe, e.g. from a horizontal orientation in the lower region all the way to the connection region. This transportation of drill pipes in a train also contributes to a reduced height of the drill rig.

When the drill pipe is oriented substantially horizontally in the lower region, an upper thread (i.e. upper thread when the drill pipe has been tilted and a thread at a leading end of the drill pipe when the drill pipe is substantially horizontally oriented) may be cleaned and/or lubricated. The method may thus further comprise cleaning and/or lubricating a leading end of a single drill pipe in the lower region, preferably when the drill pipe is in a substantially horizontal orientation.

The repeated tilting of single drill pipes may be carried out by at least two tilting devices in an alternating manner. A tilting device according to the present disclosure may be constituted by a tilting device as described below or by a tilting device as described in the Norwegian patent application 20050166, from which WO 2006075914 A1 claims priority.

The repeated tilting of single drill pipes may be carried out simultaneously with the repeated lifting of single drill pipes. For example, when a first single drill pipe is substantially vertically oriented in the lower region, a second single drill pipe may be substantially horizontally oriented in the lower region. When the first drill pipe starts to be lifted from the lower region towards the upper region, the second drill pipe starts to be tilted (or is on its way) from the substantially horizontal orientation to the substantially vertical orientation in the lower region.

Once the first drill pipe has been lifted to the upper region and the second drill pipe has been tilted from the substantially horizontal orientation to the substantially vertical orientation, a third single drill pipe may be horizontally oriented in the lower region, ready to be tilted (or on its way) etc.

This simultaneous tilting and lifting may be carried out together with the above described simultaneous lifting and moving. Thus, a first single drill pipe may be moved from the upper region to the connection region, a second single drill pipe may be lifted from the lower region to the upper region and a third single drill pipe may be tilted from the substantially horizontal orientation to the substantially vertical orientation in the lower region, at the same time.

The single drill pipes may be moved a distance of 3 to 7 meters, such as approximately 5 meters, from the upper region to the connection region. The single drill pipes may be moved from the upper region to the connection region at a speed of 0.3 to 0.7 meters per second, such as approximately 0.5 meters per second.

The method may further comprise continuously conveying single drill pipes in a substantially horizontal orientation to the lower region. The conveying movement may be carried out from a loading region to the lower region. A loading region according to the present disclosure is a region where single drill pipes can be loaded (or unloaded) to (or from) a conveying device.

The conveying may be carried out such that one single drill pipe is delivered every 20 seconds. Thus, in case single drill pipes having a length of approximately 10 meters are to be conveyed, the conveying speed may be approximately 0.5 meters per second.

The conveying movement may be carried out in a substantially horizontal direction. One or several single drill pipes may be conveyed simultaneously from the loading region to the lower region. The conveying may be carried out simultaneously with the tilting, lifting and/or moving as described above.

For example, when a first single drill pipe is at the upper region, ready to be moved to the connection region, a second single drill pipe may be substantially vertically oriented in the lower region, ready to be lifted (or on its way) to the upper region, a third single drill pipe may be substantially horizontally oriented in the lower region, ready to be tilted (or on its way) to the substantially vertical orientation, and a fourth single drill pipe may be substantially horizontally oriented in the loading region, ready to be conveyed (or on its way conveying) to the lower region.

According to a further aspect, there is provided a method for transporting drill pipes from a drill string of a drill rig comprising a plurality of connected drill pipes, the method comprising repeatingly lowering single drill pipes one by one from an upper region adjacent to an upper end of the drill string to a lower region.

The method enables a continuous transportation of drill pipes, one after the other, away from the drill string. Unless otherwise indicated, the method for transporting drill pipes from a drill string of a drill rig comprising a plurality of connected drill pipes as described in the present disclosure is reverse to the method for transporting drill pipes to a drill string according to the present disclosure.

The method may further comprise repeatingly disconnecting a single drill pipe in the connection region from the upper end of the drill string.

The method may be used to transport drill pipes from a continuously raised drill string. In addition, the method may be used to transport drill pipes from a repeatedly raised drill string, e.g. where the drill string is alternatingly raised and stopped.

The method may thus further comprise continuously raising the drill string. The drill string may be continuously raised at a speed of 0.2 to 1.0 meters per second, such as 0.3 to 1.0 meters per second, such as 0.4 to 0.6 meters per second, such as 0.5 meters per second. Alternatively, the method may comprise raising the drill string, such as alternatingly lowering and stopping the drill string.

The repeated lowering of single drill pipes may be carried out by at least two lifting devices in an alternating manner.

The method may further comprise repeatingly moving single drill pipes one by one from a connection region, where the drill pipe can be disconnected from the upper end of the drill string, to the upper region.

The repeated lowering of single drill pipes and the repeated moving of single drill pipes may be carried out simultaneously.

The method may further comprise repeatingly tilting single drill pipes one by one in the lower region from a substantially vertical orientation to a substantially horizontal orientation. The repeated tilting of single drill pipes may be carried out by at least two tilting devices in an alternating manner. This tilting contributes to a reduced height of the drill rig and a faster delivery of drill pipes.

The repeated tilting of single drill pipes may be carried out simultaneously with the repeated lowering of single drill pipes.

The method may further comprise continuously conveying single drill pipes in a substantially horizontal orientation from the lower region.

According to a further aspect, there is provided an arrangement for transporting drill pipes to a drill string of a drill rig comprising a plurality of connected drill pipes, the arrangement comprising at least two lifting devices, wherein the at least two lifting devices are configured to lift single drill pipes one by one from a lower region to an upper region adjacent to an upper end of the drill string in an alternating manner.

The lifting devices may be moved independently of each other. For example, a first lifting device may be lifted while carrying a single drill pipe while a second empty lifting device is lowered.

In case two lifting devices are employed, the lifting devices may be facing each other. The first lifting device may lift a first single drill pipe along a first path from the lower region to the upper region and the second lifting device may subsequently lift a second single drill pipe along a second path from the lower region to the upper region, substantially parallel with the first path or substantially coincident with the first path.

The lifting devices may be of any type suitable for lifting a single drill pipe from the lower region to the upper region. According to one variant, each lifting device comprises an upper gripping mechanism and a lower gripping mechanism. In this case, each lifting device may be configured to grip both ends (e.g. within 5% of the length) of the drill pipe with a gripping mechanism. This improves control of the drill pipe movement. Such gripping mechanism may be constituted by a claw.

According to an alternative variant, each lifting device comprises one (e.g. an upper or lower) gripping mechanism and one (e.g. an upper or lower) lateral supporting mechanism. Such lateral supporting mechanism may be constituted by a generally U-shaped fork configured to support a drill pipe in a direction perpendicular to its extension direction, e.g. to horizontally support a substantially vertically oriented drill pipe.

The arrangement may further comprise a device configured to continuously lower the drill string. The device may also be configured to continuously raise the drill string. The device may comprise an upper lift and a lower lift. Such device may be of various designs, for example as described in U.S. Pat. No. 3,194,313 A.

The at least two lifting devices may also be configured to lower single drill pipes one by one from the upper region to the lower region in an alternating manner. Thus, the arrangement may also be used to transport drill pipes from a drill string of a drill rig comprising a plurality of connected drill pipes.

The arrangement may further comprise a moving device configured to move a single drill pipe from the upper region to a connection region, where the drill pipe can be connected to the upper end of the drill string. By using a dedicated moving device to carry out this movement to the connection region, the arrangement provides a faster delivery of drill pipes.

Furthermore, the addition/removal of drill pipes to/from the drill string above the upper lift and the lower lift of the lowering/raising device contributes to a reduced height of the drill rig. This is because the drill rig does not need extra height for continuous travel during the time when a drill pipe is inserted between, e.g. a manipulator pair of the moving device.

The arrangement may further comprise a screwing device or connection device for screwing drill pipes to the drill string. The screwing device may for example be comprised by the moving device or by an upper lift of a device configured to continuously lower and raise the drill string.

A moving device according to the present disclosure may be designed in various ways in order to move a single drill pipe from the upper region to the connection region. According to one variant, the moving device comprises at least one gripping mechanism. The moving device may for example comprise only one gripping mechanism or one gripping mechanism and one supporting mechanism configured to laterally support the single drill pipe (e.g. horizontally support a substantially vertically oriented drill pipe). One or both of such gripping device and lateral supporting mechanism may be configured to grip or support a single drill pipe and to linearly move the same (e.g. horizontally moving a substantially vertically oriented drill pipe). This movement may for example be realized by means of an extending/retracting mechanism. Each moving device may be configured to grip and/or support both ends (e.g. within 5% of the length) of the drill pipe with a gripping mechanism and/or a supporting mechanism, respectively. This improves control of the drill pipe movement.

As an alternative to the use of one single moving device, two moving devices may be provided in order to repeatingly move single drill pipes from the upper region to the connection region in an alternating manner. Each moving device may also be configured to move a single drill pipe from the connection region to the upper region.

The arrangement may further comprise at least two tilting devices, wherein the at least two tilting device are configured to tilt single drill pipes from a substantially horizontal orientation to a substantially vertical orientation in an alternating manner.

Each tilting device may comprise a gripping mechanism and a lateral supporting mechanism. In this case, each tilting device may be configured to grip and/or support both ends (e.g. within 5% of the length) of the drill pipe with a gripping mechanism and/or a lateral supporting mechanism, respectively. This improves control of the drill pipe movement.

According to one variant, the gripping mechanism is configured to move substantially vertically. In this case, the gripping mechanism may be configured to lift a leading end of a single drill pipe, i.e. to grip a leading end of single drill pipe in a substantially horizontal orientation and to lift this end vertically until the drill pipe has been tilted to the substantially vertical orientation. The lateral supporting mechanism may then be configured to move substantially horizontally. In this case, the lateral supporting mechanism may be configured to horizontally guide a trailing end of the single drill pipe as the drill pipe is tilted from the substantially horizontal orientation to the substantially vertical orientation.

However, the above configuration may alternatively be reversed, i.e. a lateral supporting mechanism may be configured to guide a leading end of a single drill pipe substantially vertically and a gripping mechanism may be configured to grip a trailing end of the drill pipe and move substantially horizontally while tilting the drill pipe. Alternatively, each tilting device may be constituted by two gripping mechanisms.

According to one variant, when a first single drill pipe has been tilted to the substantially vertical orientation (e.g. by a first tilting device), the tilting of a second single drill pipe substantially horizontally oriented (e.g. by a second tilting device) in the lower region may be initiated.

In case two tilting devices are employed, each tilting device may be configured to tilt a single drill pipe in approximately 40 seconds. Thus, the two tilting devices may deliver a tilted single drill pipe every 20 second. In case single drill pipes having a length of approximately 10 meters, the average moving speed of each tilting device may be approximately 0.5 meters per second.

For example, if each tilting device comprises a vertically moving part (e.g. a gripping mechanism) and a horizontally moving part (e.g. a lateral supporting mechanism), the vertically moving part may be moved (e.g. upwardly) at a speed of 0.2 to 0.4 meters per second when engaging a single drill pipe and moved (e.g. downwardly) at a speed of 0.6 to 1 meters per second when not engaging a drill pipe. Correspondingly, the horizontally moving part may be moved (e.g. horizontally towards the drill pipe) at a speed of 0.2 to 0.4 meters per second when engaging a single drill pipe and moved (e.g. horizontally away from the drill pipe) at a speed of 0.6 to 1 meters per second when not engaging a drill pipe.

The at least two tilting device may also be configured to tilt single drill pipes from a substantially vertical orientation to a substantially horizontal orientation in an alternating manner.

The arrangement may further comprise a conveying device configured to continuously convey single drill pipes in a substantially horizontal orientation to the lower region. The conveying device may for example be constituted by a conveyor belt and/or rolls.

The conveying device may also be configured to continuously convey single drill pipes in a substantially horizontal orientation from the lower region.

According to a further aspect, there is provided a drill rig comprising an arrangement according to the present disclosure.

As used herein, a horizontal direction is a direction substantially parallel with a surface on which the drill rig is placed (e.g. the sea surface of a level ground surface) and a vertical direction is a direction substantially perpendicular to the horizontal direction. A substantially perpendicular/parallel relationship as used herein includes a perfectly perpendicular/parallel relationship as well as angular deviations from a perfectly perpendicular/parallel relationship with up to 5°, such as up to 2°.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
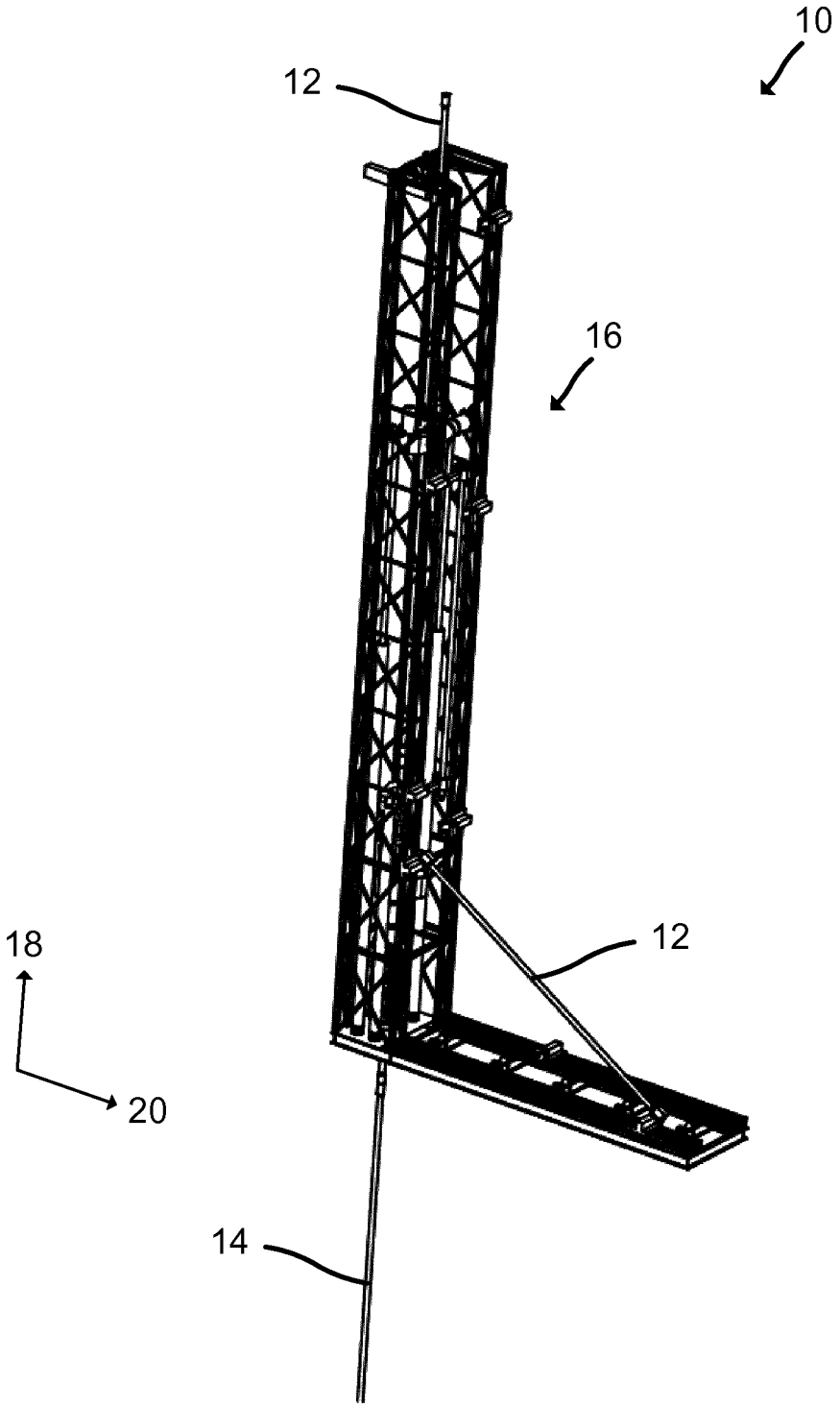
FIG. 1: schematically represents in a perspective view an arrangement for transporting drill pipes to a drill string of a drill rig.

In the following, a method for transporting drill pipes to a drill string of a drill rig comprising a plurality of connected drill pipes, a method for transporting drill pipes from the drill string and an arrangement for these purposes will be described. The same reference numerals will be used to denote the same or similar structural features.

FIG. 1 schematically represents in a perspective view an arrangement 10 for transporting drill pipes 12 to and from a drill string 14. The arrangement 10 may be at least partly supported by a derrick 16 of a drill rig. In some implementations, such as a land rig, the derrick 16 may constitute the drill rig with just utility systems to be added. FIG. 1 also shows a vertical direction 18 and a horizontal direction 20.

Figure 2:
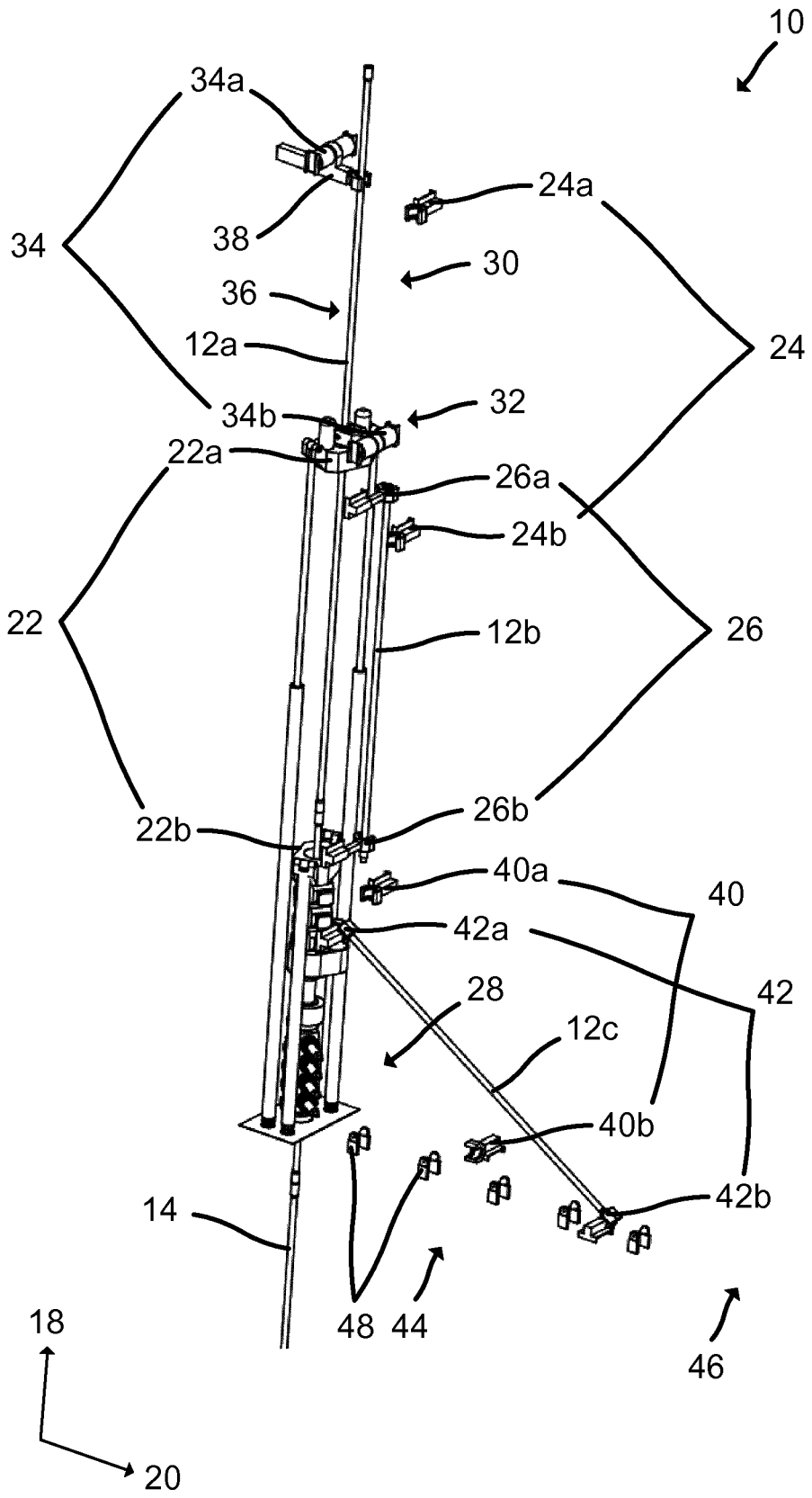
FIG. 2: schematically represents in a perspective view the arrangement and a method for transporting drill pipes to a drill string of a drill rig at a given time point T=0.

FIG. 2 schematically represents in a perspective view the arrangement 10 in FIG. 1 and a plurality of drill pipes 12*a*, 12*b*, 12*c*. In FIG. 2, the derrick 16 has been removed to improve visibility.

The arrangement 10 comprises a device 22 configured to continuously lower the drill string 14. The device 22 is also configured to continuously raise the drill string 14. In this implementation, the device 22 comprises an upper lift 22*a* and a lower lift 22*b*. Each of the upper lift 22*a* and the lower lift 22*b* comprises a gripping mechanism configured to releasably grip the drill string 14. The upper lift 22*a* and the lower lift 22*b* are configured to move independently up and down in the vertical direction 18 to raise or lower the drill string 14. The upper lift 22*a* and the lower lift 22*b* may for example be driven by hydraulic actuators.

In this example, the device 22 is configured to lower or raise the drill string 14 to/from the well bore a distance corresponding to a single drill pipe 12 every 20 second. The length of each drill pipe 12 in this example is approximately 10 meters. Each of the upper lift 22*a* and the lower lift 22*b* is configured to move at a speed of approximately 0.5 meters per second when carrying the drill string 14 and at a speed of approximately 0.75 meters per second when not carrying the drill string 14.

The arrangement 10 further comprises two lifting devices 24, 26. The two lifting devices 24, 26 are configured to lift single drill pipes 12 one by one from a lower region 28 to an upper region 30 adjacent to an upper end 32 of the drill string 14 in an alternating manner.

The lifting device 24 comprises an upper gripping mechanism 24*a* and a lower gripping mechanism 24*b*. Similarly, the lifting device 26 comprises an upper gripping mechanism 26*a* and a lower gripping mechanism 26*b*. The lifting device 24 is configured to lift single drill pipes 12 one by one along a path substantially parallel with the vertical direction 18. The lifting device 26 is configured to lift single one by one along the same path.

In this example, each lifting device 24, 26 moves approximately 15 meters from the lower region 28 to the upper region 30 and delivers a drill pipe 12 every 40 second. Thus, the lifting devices 24, 26 collectively deliver a drill pipe 12 every 20 second. The average speed of the lifting devices 24, 26 is approximately 0.6 meters per second when carrying a drill pipe 12 and approximately 1 meters per second when not carrying a drill pipe 12.

The arrangement 10 further comprises a moving device 34 configured to move a single drill pipe 12 from the upper region 30 to a connection region 36, where the drill pipe 12 can be connected to the upper end 32 of the drill string 14. The connection region 36 is positioned substantially above the drill string 14 and the upper region 30 and the connection region 36 are at substantially the same height.

The moving device 34 comprises an upper supporting mechanism 34*a* and a lower gripping mechanism 34*b*. The upper supporting mechanism 34*a* comprises a hydraulic extending/retracting mechanism 38 for moving the gripping mechanism in the horizontal direction 20. The lower gripping mechanism 34*b* comprises a screwing device for connecting (e.g. by screwing) the drill pipe 12*a* to an upper end 32 of the drill string 14.

The screwing device may alternatively be positioned on the upper lift 22*a*. As a further alternative, a spinner may be provided on the lower gripping mechanism 34*b* and a torque unit may be provided on the upper lift 22*a*.

In this example, the moving device 34 moves approximately 5 meters from the upper region 30 to the connection region 36 to deliver a drill pipe 12 every 20 second. Thus, the average speed of the moving device 34 in this example is approximately 0.5 meters per second.

The arrangement 10 further comprises two tilting devices 40, 42 configured to tilt single drill pipes 12 from a substantially horizontal orientation to a substantially vertical orientation in an alternating manner. Each tilting device 40, 42 comprises a gripping mechanism 40*a*, 42*a* and a lateral supporting mechanism 40*b*, 42*b*. The gripping mechanisms 40*a*, 42*a* are arranged to move substantially in the vertical direction 18 and the lateral supporting mechanisms 40*b*, 42*b* are arranged to move substantially in the horizontal direction 20.

Each gripping mechanism 40*a*, 42*a* of the tilting devices 40, 42 moves vertically up and down along a distance of approximately 10 meters. Each lateral supporting mechanism 40*b*, 42*b* of the tilting devices 40, 42 moves horizontally back and forth along a distance of approximately 10 meters.

In this example, each tilting device 40, 42 delivers a vertically oriented drill pipe 12 every 40 second. Thus, the tilting devices 40, 42 collectively delivers a drill pipe 12 every 20 second. The average moving speed of the tilting devices 40, 42 is thus 0.5 meters per second.

The arrangement 10 further comprises a conveying device 44 configured to continuously convey single drill pipes 12 in a substantially horizontal orientation from a loading region 46 to the lower region 28. In this implementation, the conveying device 44 is constituted by a plurality of rolls 48 (only two of five are denoted).

A method for transporting drill pipes 12 to a drill string 14 of a drill rig according to the present disclosure will now be described with reference to FIGS. 2 to 9. FIG. 2 shows the method in an ongoing state at a given time T=0. The time T=0 is not a starting point of the method but merely a point in time when the method is carried out. The method described is a trip in of the drill string 14 but this method may be reversed for a trip out of the drill string 14. Also the arrangement 10 described in FIGS. 1 to 9 is configured to transport drill pipes 12 to the drill string 14 and reversely configured, i.e. configured to transport drill pipes 12 from the drill string 14.

In FIG. 2, the upper lift 22*a* and the lower lift 22*b* are positioned at their respective end positions at a maximum distance from each other. The upper lift 22*a* takes over the weight of the drill string 14 by gripping the same with its gripping mechanism.

The moving device 34 has moved a new drill pipe 12*a* from the upper region 30 to the connection region 36. The screwing device of the lower gripping mechanism 34*b* has screwed the drill pipe 12*a* on top of the drill string 14 so that the drill pipe 12*a* now forms a part of the drill string 14.

The lifting device 24 is moving downwards after having delivered the drill pipe 12*a* to the moving device 34 in the upper region 30. The lifting device 26 is moving upwards from the lower region 28 towards the upper region 30 while carrying a further drill pipe 12*b*.

The tilting device 40 is on its way down to collect a further drill pipe (not shown) from the conveying device 44 in the lower region 28 after having delivered the vertically oriented drill pipe 12*b* to the lifting device 26 in the lower region 28. More specifically, the gripping mechanism 40*a* of the tilting device 40 is moving vertically downwards and the lateral supporting mechanism 40*b* of the tilting device 40 is moving horizontally (to the right in FIG. 2).

The tilting device 42 is tilting a further drill pipe 12*c* from a horizontal orientation to a vertical orientation. More specifically, the gripping mechanism 42*a* of the tilting device 42 is moving upwards and the lateral supporting mechanism 42*b* of the tilting device 42 is moving horizontally (to the left in FIG. 2).

Figure 3:
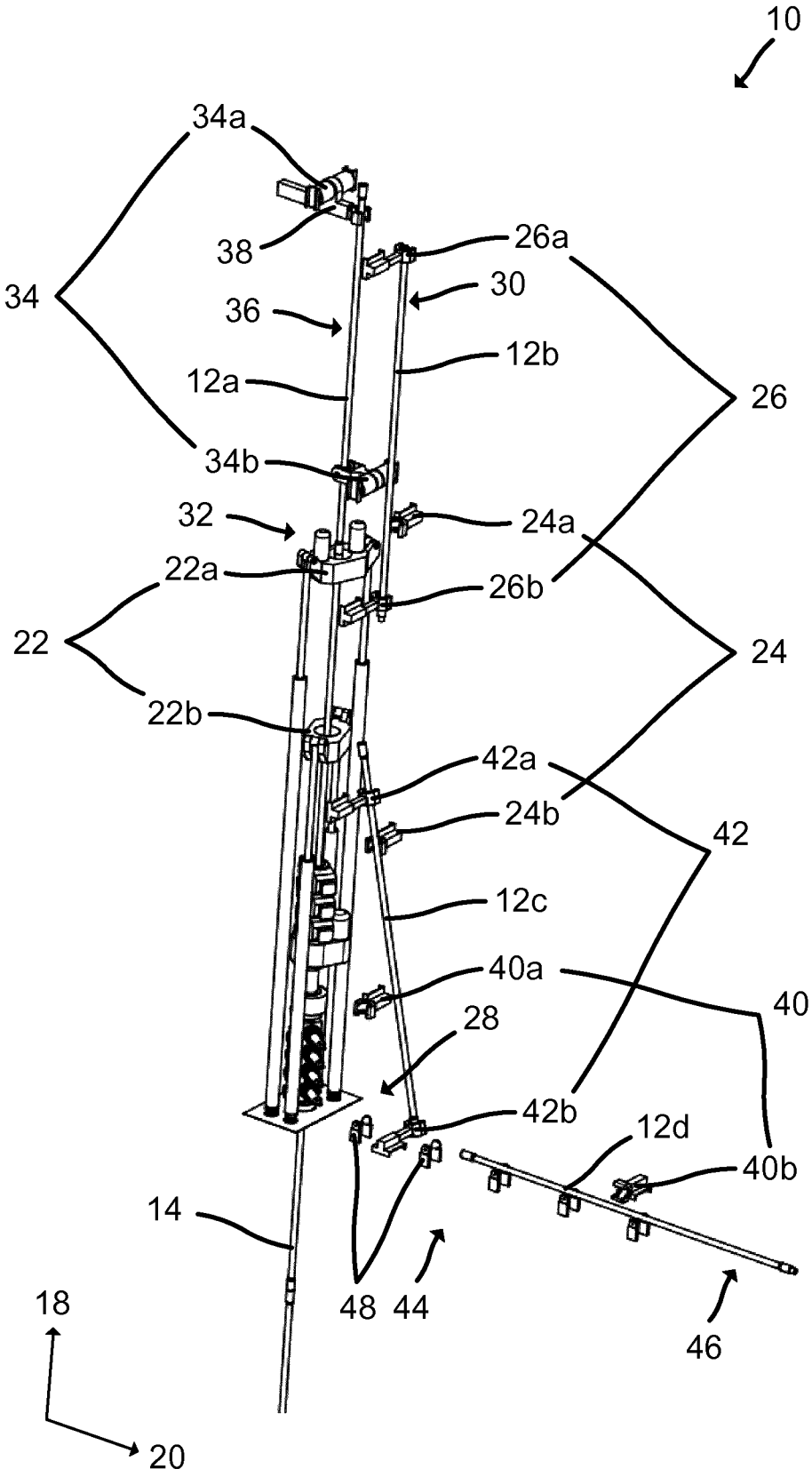
FIG. 3: schematically represents the arrangement and the method at a time T=5.

FIG. 3 schematically represents the arrangement 10 and the method at a time T=5, i.e. 5 seconds after the representation in FIG. 2. In FIG. 3, the upper lift 22*a* is moving downwardly with the drill string 14 and the lower lift 22*b* is moving upwardly to later overtake the drill string 14.

The upper supporting mechanism 34*a* of the moving device 34 has followed and supported the upper part of the drill pipe 12*a* while it was screwed onto the top of the drill string 14. The lower gripping mechanism 34*b* releases the lower part of the drill pipe 12*a* and moves horizontally towards the upper region 30 in order to overtake the lower part of the next drill pipe 12*b* from the lifting device 26.

The lifting device 24 is moving downwards from the upper region 30 towards the lower region 28 in order to collect a further drill pipe 12*c* from the tilting device 42 in vertical orientation. The lifting device 26 is moving upwards from the lower region 28 towards the upper region 30 while carrying the drill pipe 12*b*.

The tilting device 40 is on its way down (tilting towards the horizontal orientation) to collect a further drill pipe 12*d* in horizontal orientation from the conveying device 44 in the lower region 28. The tilting device 42 tilts the drill pipe 12*c* from the horizontal orientation towards the vertical orientation in the lower region 28.

Figure 4:
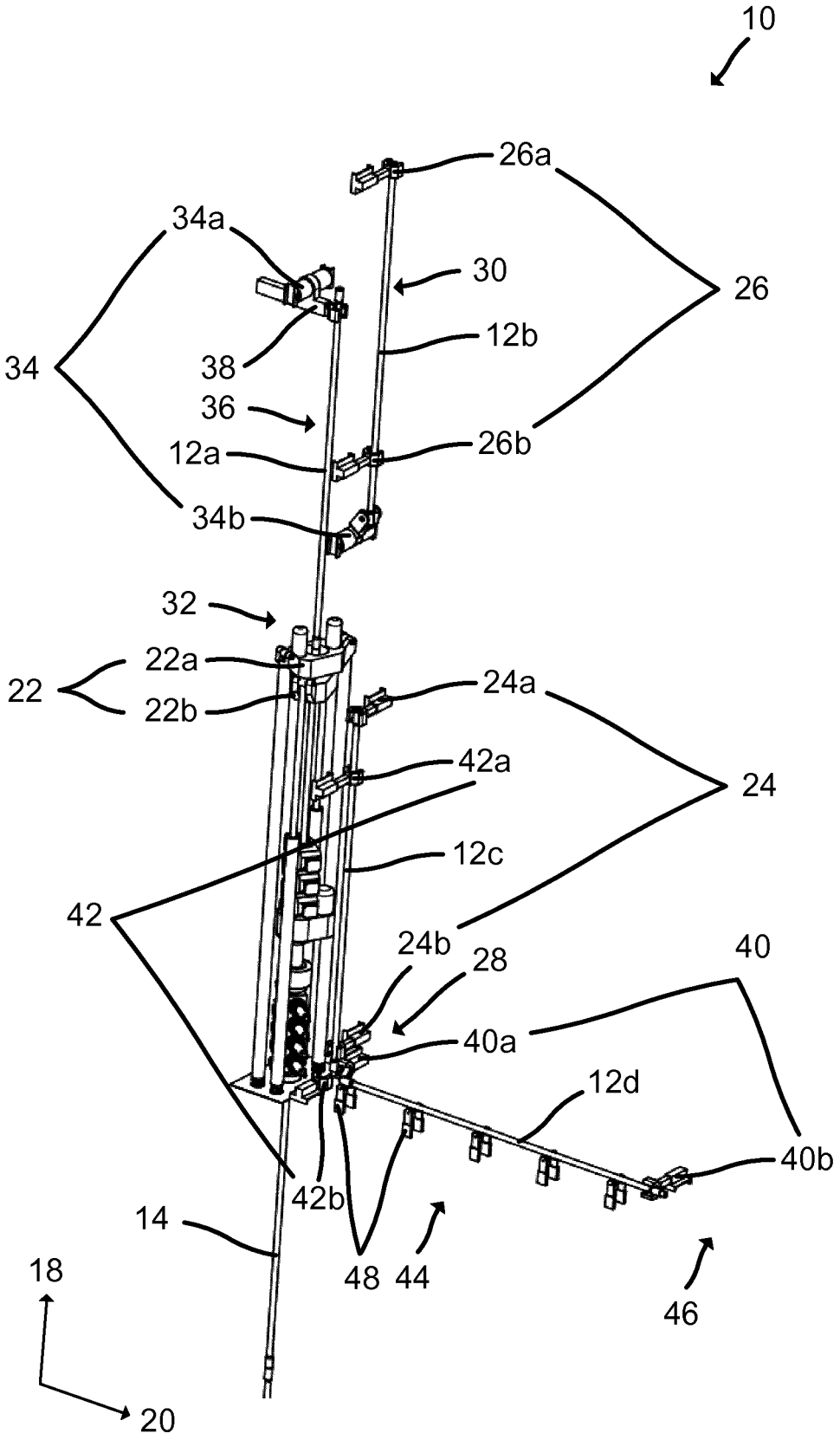
FIG. 4: schematically represents the arrangement and the method at a time T=10.

FIG. 4 schematically represents the arrangement 10 and the method at a time T=10, i.e. 10 seconds after the representation in FIG. 2. In FIG. 4, the upper lift 22*a* and the lower lift 22*b* of the device 22 are brought together. The gripping mechanism of the lower lift 22*b* engages the drill string 14 and the gripping mechanism of the upper lift 22*a* releases the drill string 14. Thereby, the lower lift 22*b* takes over the weight of the drill string 14.

The upper supporting mechanism 34*a* of the moving device 34 follows and supports the upper part of the drill pipe 12*a* that has been moved to the connection region 36 and screwed on top of the drill string 14. The lower gripping mechanism 34*b* of the moving device 34 has been moved to the upper region 30 to overtake the lower part of the next drill pipe 12*b* from the lifting device 26.

The lifting device 24 is in position to take over the next drill pipe 12*c* in vertical orientation from the tilting device 42 in the lower region 28. The lifting device 26 is in the upper region 30 with the drill pipe 12*b*.

The tilting device 40 is in position to receive a further drill pipe 12*d* in horizontal orientation from the conveying device 44 in the lower region 28. The tilting device 42 has tilted the drill pipe 12*c* to the vertical orientation in the lower region 28. At this time, a lower threaded end (i.e. a trailing end) of the vertically oriented drill pipe 12*c* is cleaned and lubricated.

Figure 5:
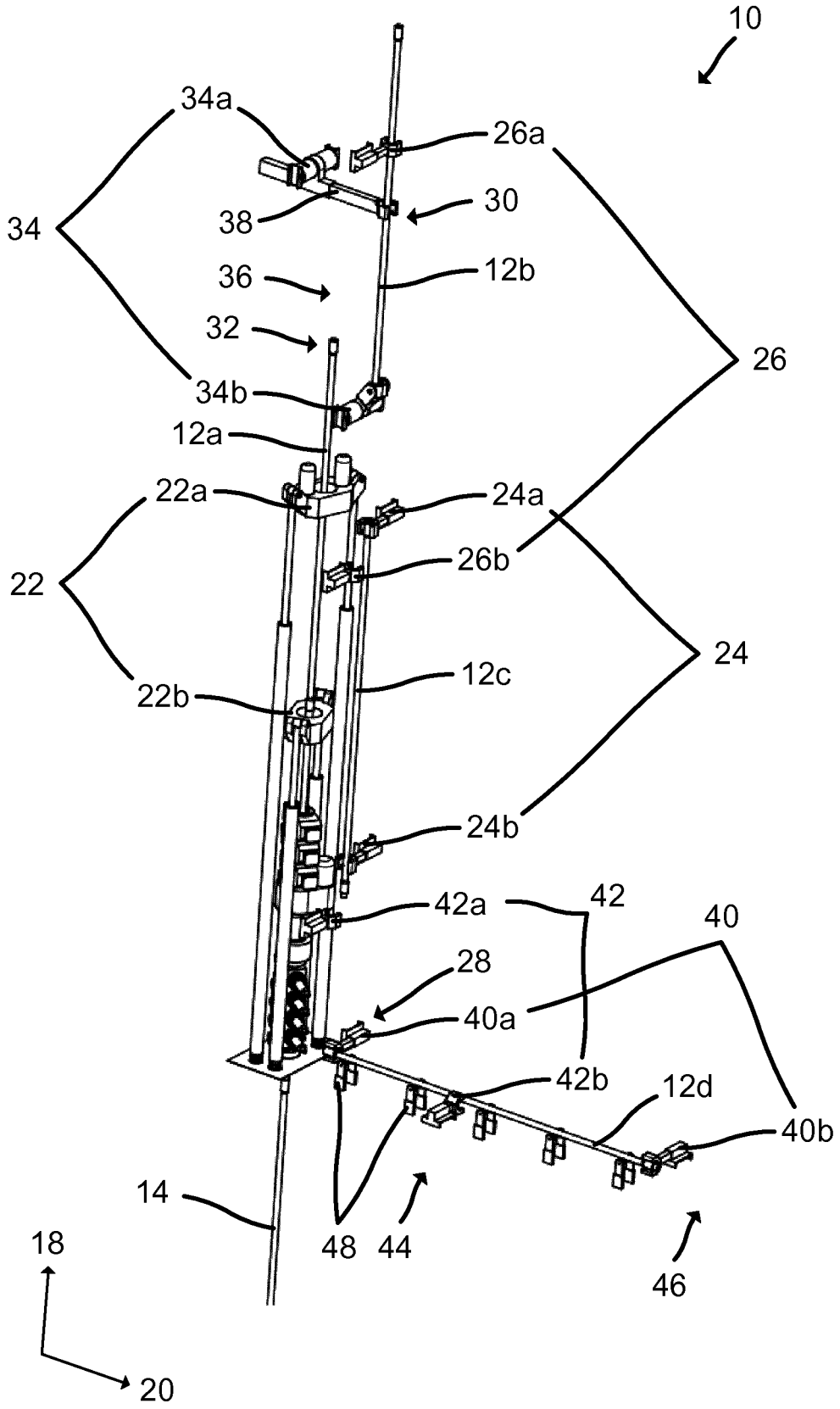
FIG. 5: schematically represents the arrangement and the method at a time T=15.

FIG. 5 schematically represents the arrangement 10 and the method at a time T=15, i.e. 15 seconds after the representation in FIG. 2. In FIG. 5, the lower lift 22*b* of the device 22 is moving downwards while carrying the drill string 14 and the upper lift 22*a* of the device 22 is moving upwards to overtake the drill string 14.

The upper supporting mechanism 34*a* of the moving device 34 has released the drill pipe 12*a* in the center position (above the drill string 14) and is moving from the connection region 36 to the upper region 30 to receive and support the upper part of the next single drill pipe 12*b*. The lower gripping mechanism 34*b* of the moving device 34 lifts the drill pipe 12*b* while the upper gripping mechanism 26*a* of the lifting device 26 supports the drill pipe 12*b*.

The lifting device 24 is moving upwards from the lower region 28 towards the upper region 30 with the drill pipe 12*c*. The lower gripping mechanism 26*b* of the lifting device 26 is moving downwards from the upper region 30 towards the lower region 28 to collect the next drill pipe 12*d* in vertical orientation from the tilting device 40.

The tilting device 40 is in position to receive the horizontally oriented drill pipe 12*d* from the conveying device 44 in the lower region 28. At this point, the upper end (i.e. the leading end) of the drill pipe 12*d* is cleaned and lubricated.

The tilting device 42 is on its way down (the gripping mechanism 42*a* is moving downwards and the lateral supporting mechanism 42*b* is moving horizontally) to receive a further horizontally oriented drill pipe from the conveying device 44 in the lower region 28.

Figure 6:
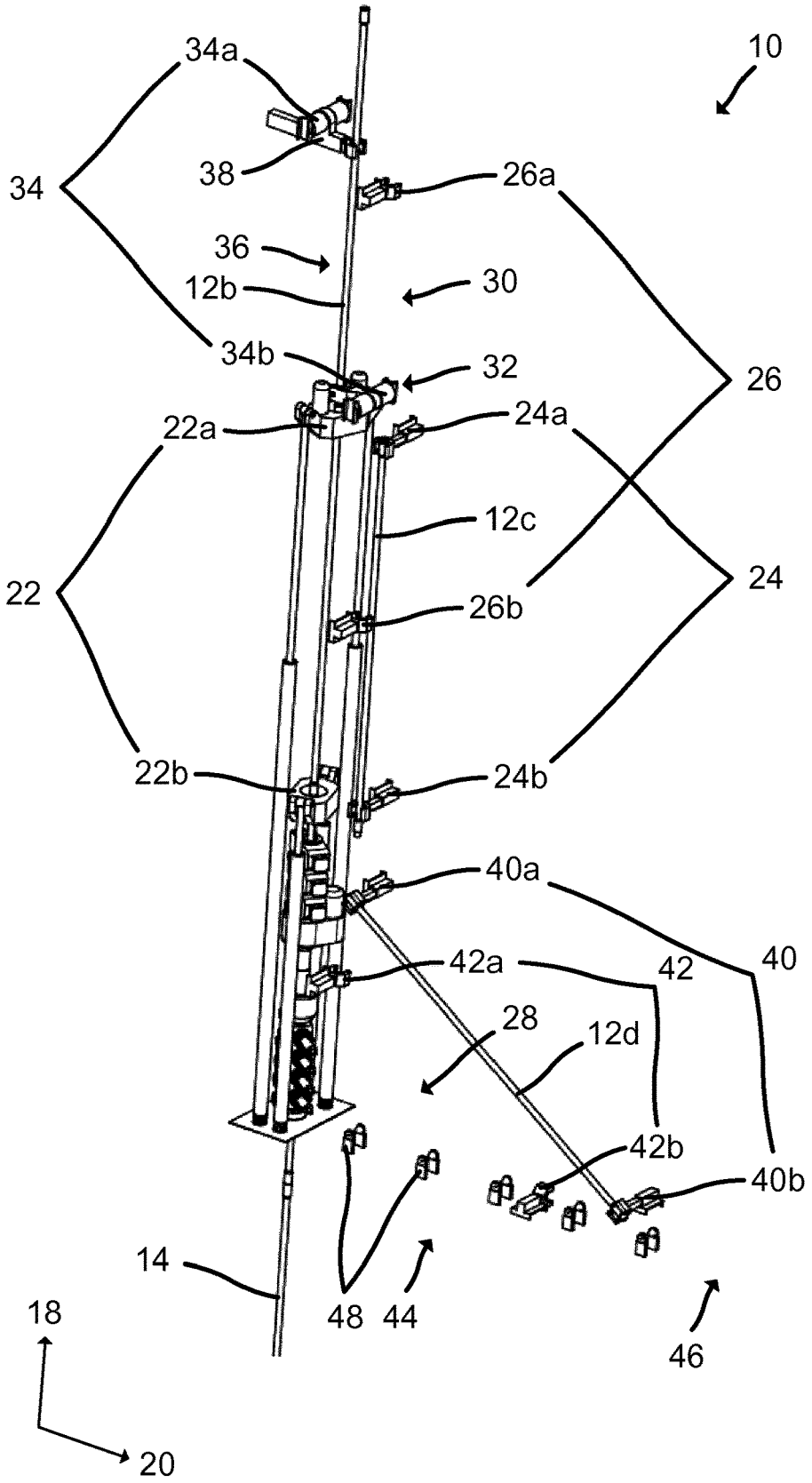
FIG. 6: schematically represents the arrangement and the method at a time T=20.

FIG. 6 schematically represents the arrangement 10 and the method at a time T=20, i.e. 20 seconds after the representation in FIG. 2. In FIG. 6, the upper lift 22*a* and the lower lift 22*b* are at the maximum distance from each other. The gripping mechanism of the upper lift 22*a* engages the drill string 14 and the gripping mechanism of the lower lift 22*b* disengages the drill string 14. Thereby, the upper lift 22*a* takes over the weight of the drill string 14.

The moving device 34 has delivered the next drill pipe 12*b* from the upper region 30 to the connection region 36 and screwed the drill pipe 12*b* onto the upper end 32 of the drill string 14.

The lifting device 24 is moving upwards from the lower region 28 towards the upper region 30 with the next drill pipe 12*c*. After having delivered the drill pipe 12*b* to the moving device 34, the lifting device 26 is moving downwards from the upper region 30 towards the lower region 28 for collecting the next drill pipe 12*d* in vertical orientation from the tilting device 40 in the lower region 28.

The tilting device 40 is tilting the drill pipe 12*d* from the horizontal orientation towards the vertical orientation in the lower region 28. After having delivered the vertically oriented drill pipe 12*c* to the lifting device 24, the tilting device 42 is moving downwards for collecting the next drill pipe in horizontal orientation from the conveying device 44 in the lower region 28.

Figure 7:
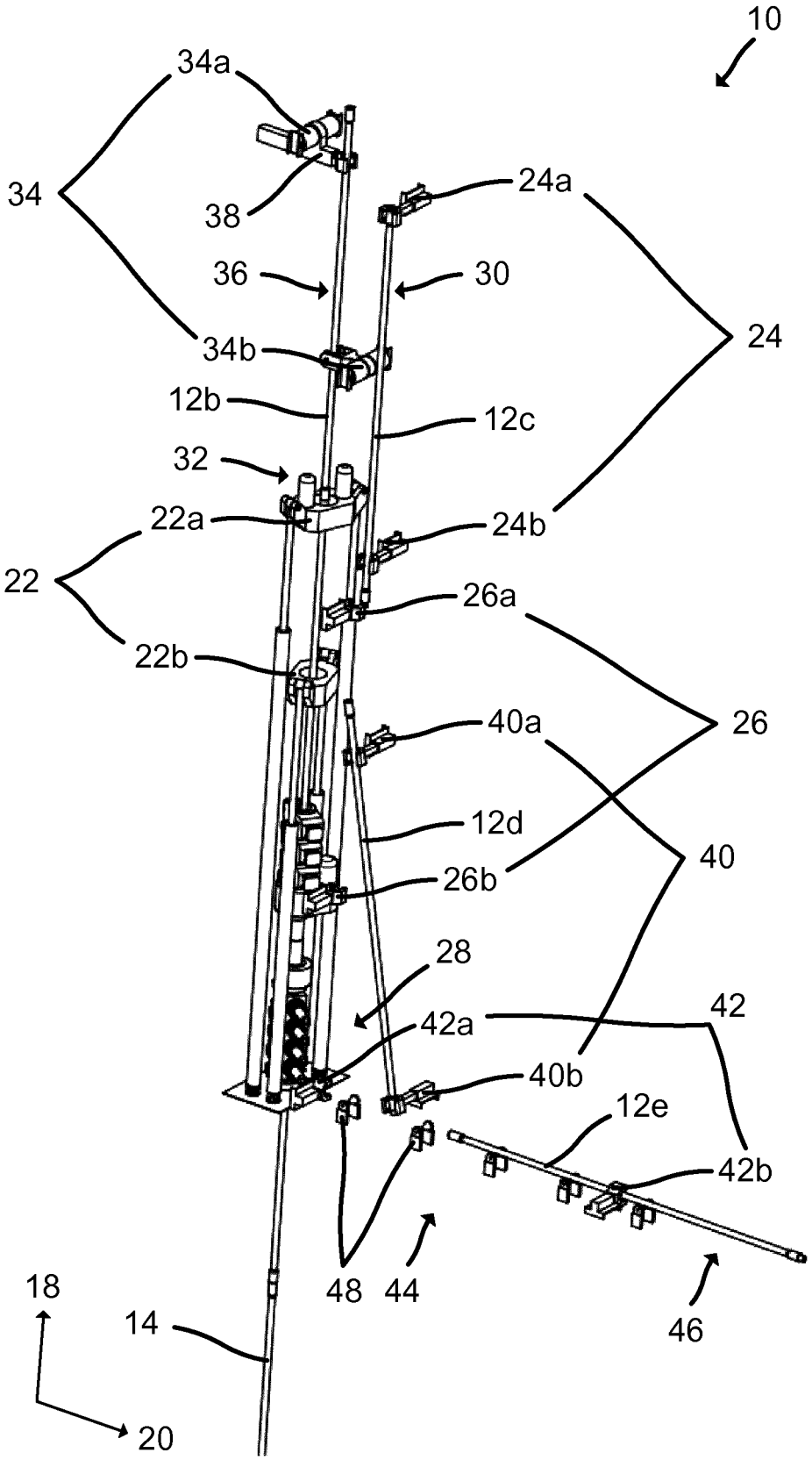
FIG. 7: schematically represents the arrangement and the method at a time T=25.

FIG. 7 schematically represents the arrangement 10 and the method at a time T=25, i.e. 25 seconds after the representation in FIG. 2. In FIG. 7, the upper lift 22*a* of the device 22 is moving downwards with the drill string 14 and the lower lift 22*b* of the device 22 is moving upwards in order to overtake the drill string 14.

The upper supporting mechanism 34*a* of the moving device 34 follows and supports the upper portion of the drill pipe 12*b* in the connection region 36 while the drill pipe 12*b* has been screwed onto the upper end 32 of the drill string 14. The lower gripping mechanism 34*b* of the moving device 34 releases the lower portion of the drill pipe 12*b* and starts to move from the connection region 36 towards the upper region 30 to receive the lower portion of the next drill pipe 12*c*.

The lifting device 24 is moving upwards from the lower region 28 towards the upper region 30 with the next drill pipe 12*c*. The lifting device 26 is moving downwards from the upper region 30 towards the lower region 28 to receive the next drill pipe 12*d* in vertical orientation from the tilting device 40 in the lower region 28.

The tilting device 40 tilts the drill pipe 12*d* from the horizontal orientation towards the vertical orientation. The tilting device 42 is moving downwards to collect a further horizontally oriented drill pipe 12*e* from the conveying device 44 in the lower region 28.

Figure 8:
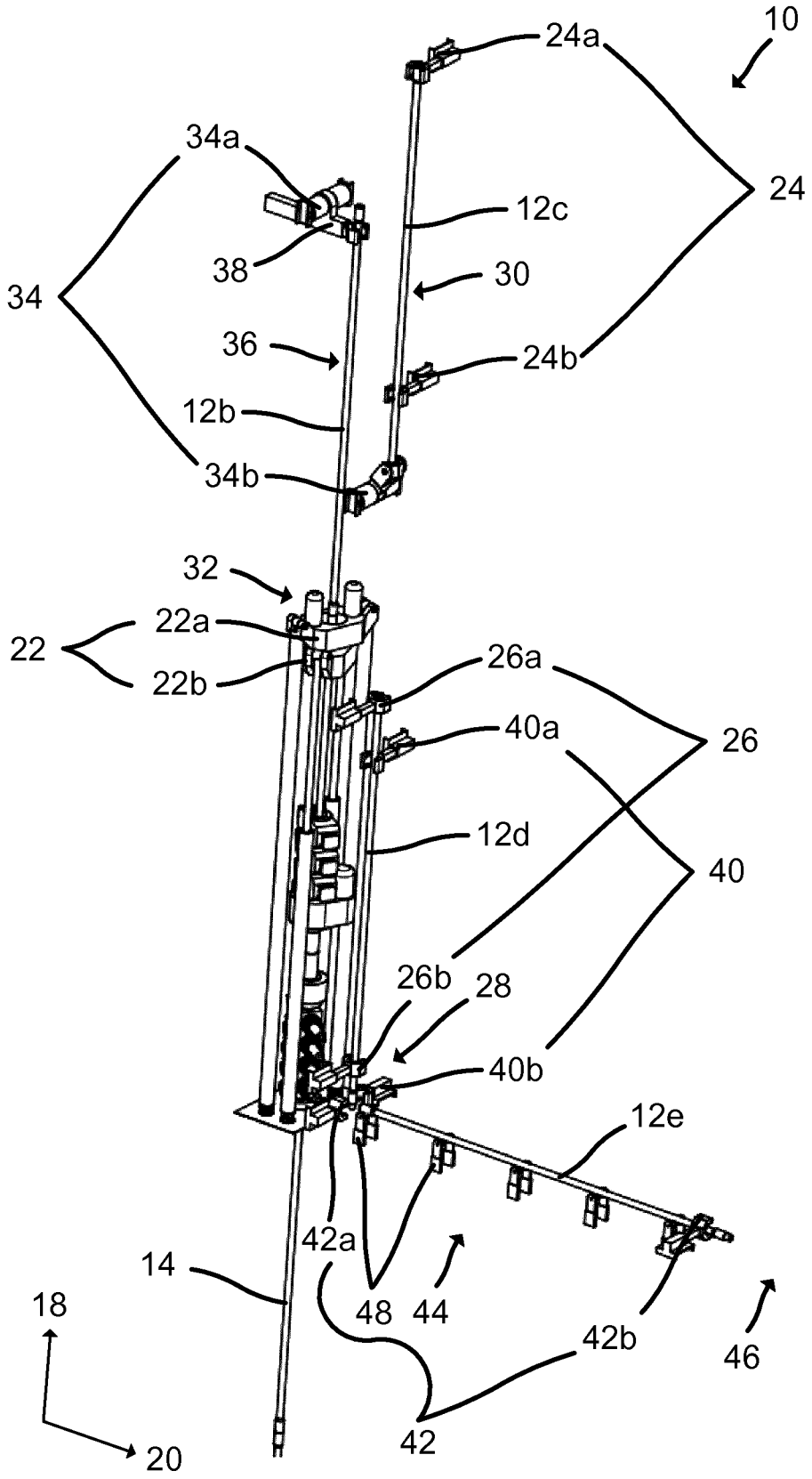
FIG. 8: schematically represents the arrangement and the method at a time T=30.

FIG. 8 schematically represents the arrangement 10 and the method at a time T=30, i.e. 30 seconds after the representation in FIG. 2. In FIG. 8, the upper lift 22*a* and the lower lift 22*b* are brought together. The gripping mechanism of the upper lift 22*a* releases the drill string 14 and the gripping mechanism of the lower lift 22*b* grabs the drill string 14. The lower lift 22*b* thus takes over the weight of the drill string 14.

The upper supporting mechanism 34*a* of the moving device 34 follows and supports the upper portion of the drill pipe 12*b* that has been moved to the connection region 36 and screwed onto the upper end 32 of the drill string 14. The lower gripping mechanism 34*b* of the moving device 34 is in position to take over the lower portion of the next drill pipe 12*c* from the lifting device 24 in the upper region 30.

The lifting device 24 is in the upper region 30 with the drill pipe 12*c*. The lifting device 26 is in the lower region 28 to collect the next drill pipe 12*d* in vertical orientation from the tilting device 40.

The tilting device 40 holds a drill pipe 12*d* in vertical orientation in the lower region 28. At this point, the external thread at the lower end (i.e. the trailing end) of the drill pipe 12*d* is cleaned and lubricated. The tilting device 42 is in horizontal position in the lower region 28 and ready to collect the next drill pipe 12*e* in horizontal orientation from the conveying device 44.

Figure 9:
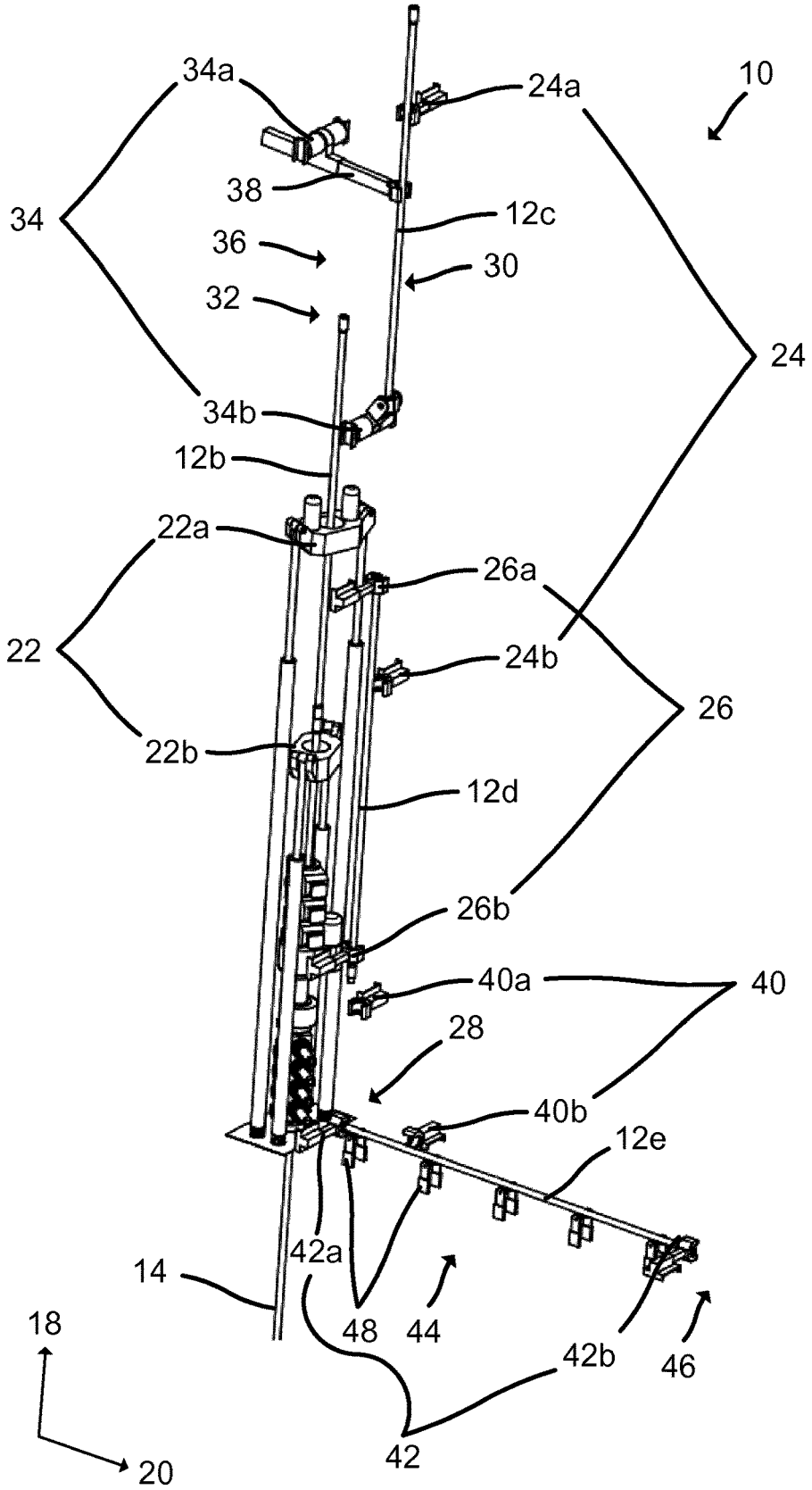
FIG. 9: schematically represents the arrangement and the method at a time T=35.

FIG. 9 schematically represents the arrangement 10 and the method at a time T=35, i.e. 35 seconds after the representation in FIG. 2. In FIG. 9, the lower lift 22*b* of the device 22 is moving downwards with the drill string 14 and the upper lift 22*a* of the device 22 is moving upwards to overtake the drill string 14.

The upper supporting mechanism 34*a* of the moving device 34 has released the drill pipe 12*b* and has moved from the connection region 36 to the upper region 30 to receive and support the upper portion of the next drill pipe 12*c*. The lower gripping mechanism 34*b* of the moving device 34 grabs a lower portion of the drill pipe 12*c* while the upper gripping mechanism 24*a* of the lifting device 24 supports the upper portion of the drill pipe 12*c*.

The lower gripping mechanism 24*b* of the lifting device 24 moves downwards from the upper region 30 towards the lower region 28 to collect the next drill pipe 12*e* in vertical orientation from the tilting device 42 in the lower region 28. The lifting device 26 is moving upwards from the lower region 28 towards the upper region 30 with the next drill pipe 12*d*.

The tilting device 40 is moving downwards from the vertical orientation to the horizontal orientation in order to collect the next drill pipe in horizontal orientation from the conveying device 44 in the lower region 28. The tilting device 42 is in position to collect the drill pipe 12*e* in horizontal orientation from the conveying device 44 in the lower region 28. At this time, the internal thread of the leading end of the drill pipe 12*e* is cleaned and lubricated.

At a time T=40, i.e. 40 seconds after the representation in FIG. 2, the method starts over as shown in FIG. 2. The method for transporting drill pipes 12 from the drill string 14 is reverse to the method for transporting drill pipes 12 to the drill string 14 as described in FIGS. 2 to 9.

While the present disclosure has been described with reference to exemplary embodiments, it will be appreciated that the present invention is not limited to what has been described above. For example, it will be appreciated that the dimensions of the parts and the moving speeds may be varied as needed. Accordingly, it is intended that the present invention may be limited only by the scope of the claims appended hereto.

The invention claimed is:

1. A method for transporting drill pipes to a drill string of a drill rig comprising a plurality of connected drill pipes, the method comprising:

continuously lowering the drill string;

repeatingly lifting single drill pipes one by one from a lower region to an upper region adjacent to an upper end of the drill string by at least two lifting devices in an alternating manner;

repeatingly moving single drill pipes one by one by one or more moving devices from the upper region to a connecting region, where the single drill pipes can be connected to the upper end of the drill string; and connecting the single drill pipes one by one to the drill string while the drill string is lowered, wherein the repeated lifting of single drill pipes and the repeated moving of single drill pipes are carried out simultaneously.

2. The method according to claim 1, further comprising repeatingly tilting single drill pipes one by one in the lower region from a substantially horizontal orientation to a substantially vertical orientation.

3. The method according to claim 2, wherein the repeated tilting of single drill pipes is carried out by at least two tilting devices in an alternating manner.

4. The method according to claim 2, wherein the repeated tilting of single drill pipes is carried out simultaneously with the repeated lifting of single drill pipes.

5. The method according to claim 1, further comprising continuously conveying single drill pipes in a substantially horizontal orientation to the lower region.

6. A method for transporting drill pipes from a drill string of a drill rig comprising a plurality of connected drill pipes, the method comprising:

continuously raising the drill string;

disconnecting single drill pipes one by one from the drill string while the drill string is raised;

repeatingly moving single drill pipes one by one by one or more moving devices from a connection region, where the single drill pipe is disconnected from an upper end of the drill string, to an upper region adjacent to the upper end of the drill string; and repeatingly lowering single drill pipes one by one from the upper to a lower region by at least two lifting devices in an alternating manner, wherein the repeated lowering of single drill pipes and the repeated moving of single drill pipes are carried out simultaneously.

7. The method according to claim 6, further comprising repeatingly tilting single drill pipes one by one in the lower region from a substantially vertical orientation to a substantially horizontal orientation.

8. The method according to claim 7, wherein the repeated tilting of single drill pipes is carried out by at least two tilting devices in an alternating manner.

9. The method according to claim 7, wherein the repeated tilting of single drill pipes is carried out simultaneously with the repeated lowering of single drill pipes.

10. The method according to claim 6, further comprising continuously conveying single drill pipes in a substantially horizontal orientation from the lower region.

11. An arrangement for transporting drill pipes to a drill string of a drill rig comprising a plurality of connected drill pipes, the arrangement comprising:

at least two lifting devices, wherein the at least two lifting devices are configured to lift single drill pipes one by one from a lower region to an upper region adjacent to an upper end of the drill string in an alternating manner; and a moving device configured to move a single drill pipe from the upper region to a connection region, where the drill pipe can be connected to the upper end of the drill string.

12. The arrangement according to claim 11, further comprising at least two tilting devices, wherein the at least two tilting devices are configured to tilt single drill pipes from a substantially horizontal orientation to a substantially vertical orientation in an alternating manner.

13. The arrangement according to claim 11, further comprising a conveying device configured to continuously convey single drill pipes in a substantially horizontal orientation to the lower region.

14. A drill rig comprising an arrangement according to claim 11.

15. The arrangement according to claim 11, further comprising a device configured to continuously lower the drill string.

16. The arrangement according to claim 15, further comprising a screwing device arranged to screw drill pipes to the drill string while the drill string is lowered.

17. The arrangement according to claim 11, further comprising a screwing device arranged to screw drill pipes to the drill string while the drill string is lowered.

* * * * *